United States Patent [19]

Anhalt

[11] Patent Number: 4,512,070

[45] Date of Patent: Apr. 23, 1985

[54] SAW CHAIN RIVET SPINNER

[76] Inventor: Richard C. Anhalt, Rte. 9, Box 1B, Brainerd, Minn. 56401

[21] Appl. No.: 499,816

[22] Filed: Jun. 1, 1983

[51] Int. Cl.[3] ..... B23P 11/00

[52] U.S. Cl. ..... 29/243.53; 59/7; 72/125

[58] Field of Search ..... 29/243.53, 243.54, 243.55; 59/6, 7; 72/476, 115, 125; 408/9, 13

[56] References Cited

U.S. PATENT DOCUMENTS

| | | | |
|---|---|---|---|
| 542,454 | 7/1895 | Waible et al. | 59/7 |
| 1,113,900 | 10/1914 | Jackson | 72/125 |
| 1,505,691 | 8/1924 | Barkstrom | 59/7 |
| 1,966,295 | 7/1934 | Heilman | 72/125 |
| 3,135,141 | 6/1964 | Aitken | 59/7 |
| 3,182,441 | 5/1965 | Simmons et al. | 59/7 |
| 3,182,442 | 2/1963 | Granberg | 59/7 |
| 3,233,402 | 2/1966 | Urbaitis | 59/7 |

OTHER PUBLICATIONS

Efco Industries advertisement entitled "The Efficiency of a Chain Saw", showing a bench mounted rivet spinner from Dec. 1982 *Chain Saw Age,* p. 25.

Pp. 1, 2, 55 and 56 of 1983 Omark Industries brochure showing the "Oregon" Chain Rivet Spinner.

Early 1983 Efco Industries magazine advertisement entitled "Efco Accessories Keep Chain Saws in Their Best Form", and shown an electric bench rivet spinner.

Herr Manufacturing Co., Inc. advertisement entitled "Herr Chain Saw Parts & Accessories", showing a bench mounted rivet spinner from Dec. 1982 *Chain Saw Age,* p. 17.

P. 10714 of the 1981 Thomas Register showing a Spinn O Matic orbital forming system and a Black & Webster orbital riveter.

*Primary Examiner*—James L. Jones, Jr.

*Attorney, Agent, or Firm*—Kinney & Lange

[57] ABSTRACT

A saw chain rivet spinner includes a base, a support portion secured to and extending upwardly from the base and a spindle sleeve secured to the support portion and spaced above the base. A rotatable spindle, which has an upper end and a lower end defining a generally vertical axis of rotation for the spindle, is slideably mounted with respect to the spindle sleeve for axial movement relative to the spindle sleeve. A spring mounted between the spindle and the spindle sleeve urges the spindle axially upwardly toward a first raised position. A manually actuated cam mounted with respect to the spindle and spindle sleeve is operable selectively to move the spindle axially downwardly toward a second lowered position wherein the lower end of the spindle is proximate the base. A rivet anvil is mounted on the lower end of the spindle for engaging a saw chain rivet when the spindle is moved downwardly to its second lowered position and a rivet support die is mounted on the base and aligned to support the rivet engaged by the rivet anvil. A motor is operably connected to the spindle to rotate the spindle and rivet anvil mounted thereon, and a switch responsive to the position of the spindle actuates the motor only when the spindle is moved downwardly toward the base.

18 Claims, 5 Drawing Figures

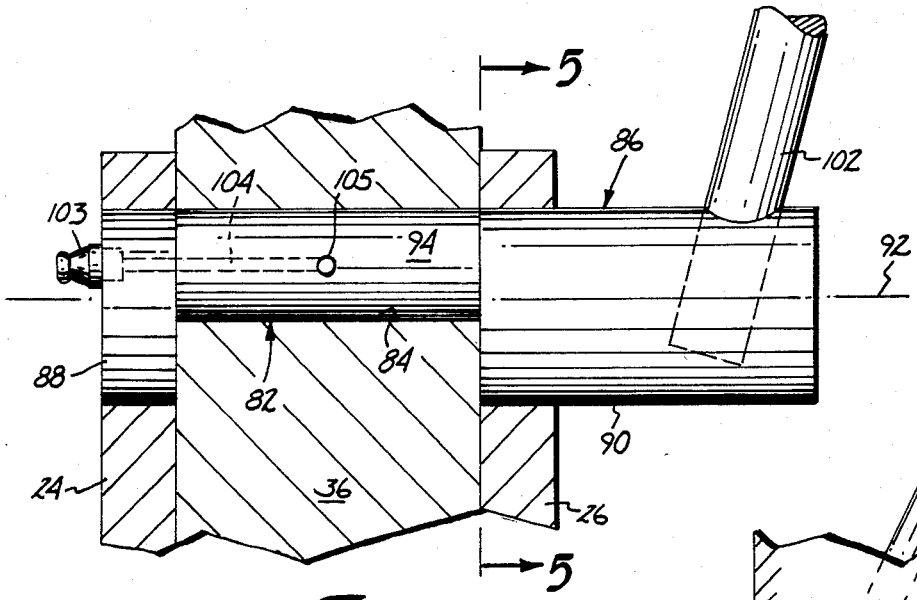
Fig.4
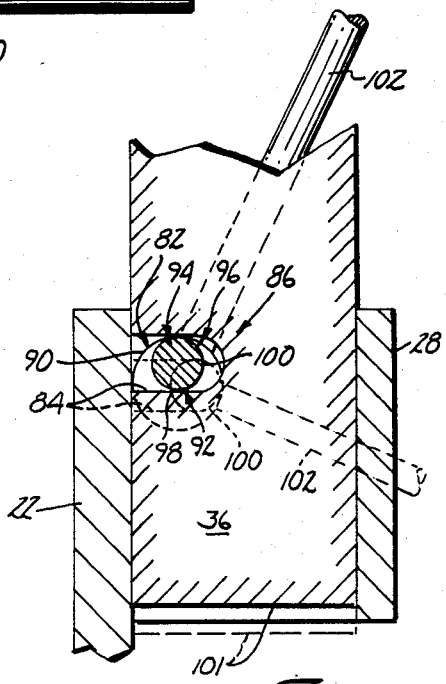
Fig.5
Fig.3
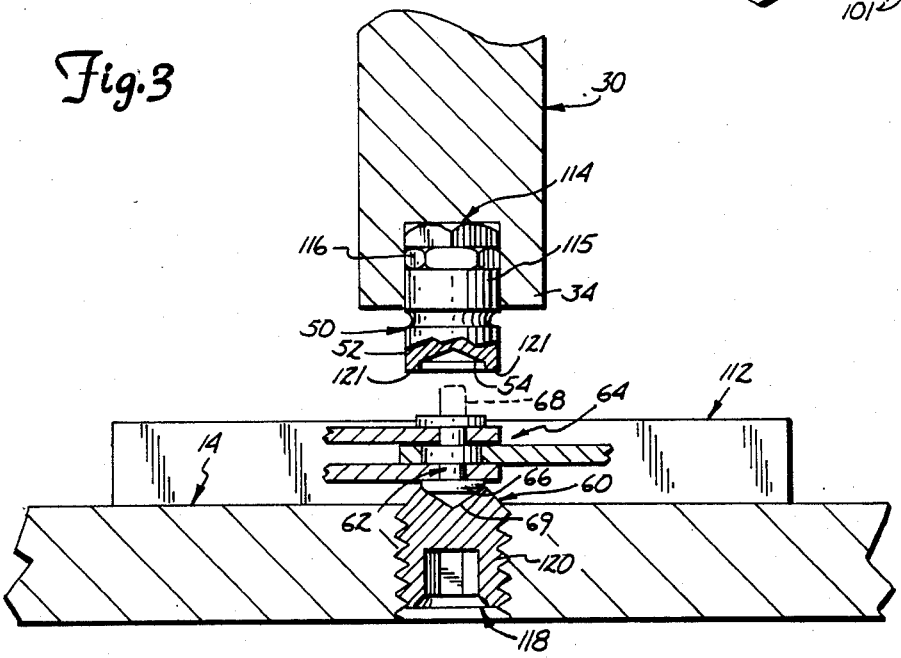

SAW CHAIN RIVET SPINNER

BACKGROUND OF THE INVENTION

1. Field of the Invention.

The present invention relates to devices for the assembly of chain saw chains, and particularly to a device for the head spinning of a rivet in such chains.

2. Description of the Prior Art.

The saw chains used on chain saws include the chain elements of drive links, cutters, pre-set tie straps and tie straps. These elements are held together by a plurality of rivets which typically have a "head" pre-formed at one end prior to assembly, with the other end of the rivet being formed or headed after the chain elements have been put together. Such saw chains are typically shipped to chain saw distributors in the form of 100-foot reels. A distributor will then in turn ship the saw chain to its dealers in one of two forms—reel form or loop form. The dealer then supplies the end user or consumer with the saw chain in loop form for use on a chain saw.

A loop of saw chain is a specific length of chain for a specific type of chain saw, and is formed from the original 100-foot saw chain reel. To form such a loop, at least one of the rivets in the original reel must be removed to permit disassembly of the chain elements. Once a loop of desired size has been separated from the reel, the ends of the loop must then be reattached with a new rivet for use on a chain saw.

Examples of devices for heading rivets on chains in a chain manufacturing facility are shown in U.S. Pat. No. 3,182,441, granted to Simmons et al. on May 11, 1965 and U.S. Pat. No. 542,454, granted to Weibel et al. on July 9, 1895. Other orbital forming devices for automatically heading rivets on a high production scale are similar to those orbital forming machines or orbital riveters of VSI Automation of Detroit, Mich. and Black & Webster, Inc. of Waltham, Mass. Rivets are headed by these devices by providing an abutting surface on the pre-formed head of the rivet and engaging the unformed end of the rivet by a rapidly spinning member which is shaped so that when pressure is exerted by the spinning member along the axis of the rivet, a head is formed at the end of the rivet to secure the rivet about the elements of the chain.

A distributor or dealer does not require a high production device for rivet head spinning such as those described above. All that is required is an efficient and easy-to-use device for the occasional attachment of the ends of a loop together to form a saw chain loop for a chain saw. To this end, a number of manual rivet spinners have been designed. Typical of those rivet spinners are the table or benchtop chain rivet spinners manufactured by Herr Manufacturing Company of Tonawanda, N.Y. and the Oregon Saw Chain Division of Omark Industries, of Portland, Ore. Another manufacturer of such devices is Efco Industries of Piano, Italy. These manual rivet spinners have a spin head rotatably mounted on a base and an engagement member spaced axially from spin head for engaging the already formed head of the rivet to be headed. The rivet is entrapped between these two heads, and the operator manually rotates the spinning head to form the rivet head while at the same time forcing the engagement head toward the spinning head to maintain a compression force along the rivet's axis. These devices are quite slow in operation, because of the time required to align the chain and position the heads. In addition, the operator must use two hands for the spinning operation.

Efco Industries also manufactures a rivet spinner device which it calls "Electric Bench Rivet Spinner." This device has a floor stand, at the upper end of which is a vertical spindle rotated by an electric motor. A rivet to be headed is placed on a support plate and the lower end of the spindle is lowered into engagement with the unformed end of the rivet while the motor is turning the spindle to form the rivet head. The device is apparently operated by means of a foot pedal arrangement adjacent the floor. This control arrangement and the floor stand upon which the rivet spinner is mounted necessarily require extra floor space for accommodating this machine. These features also make it impossible to mount this rivet spinner on an existing bench for table top use.

A different type of tool for assembling chains is shown in U.S. Pat. No. 3,135,141, granted to Aitken on June 2, 1964. With this device, the rivet to be worked is positioned on a base with its axis aligned generally vertically. Spaced above the base is a rotatable shaft, the lower end of which can be lowered into engagement with the rivet by a handle secured to a cam located at the upper end of the shaft. The shaft is spun manually by a handle extending normally thereto, so that the operation of this device as a rivet spinner requires the use of two hands.

Two other manual chain assembly devices are shown in U.S. Pat. No. 3,233,402, granted to Urbaitis on Feb. 8, 1966 and U.S. Pat. No. 3,182,442, granted to Granberg on May 11, 1965. Both of these devices are hand held, with the Urbaitis device being small enough in size to be carried in a pocket. The Granberg device has a vice-grip type action for engaging the chain rivet being worked. Neither of these devices provides suitable stability, reliability or rivet head forming capability.

The manual rivet spinners presently in use are very laborious and time consuming for an operator, which raises the cost of such services when provided by distributors and/or dealers of saw chains. The present invention provides a bench or table top saw chain assembly device suitable for high quality, low production operation. After the saw chain has been positioned for work, only one hand of an operator is required to manipulate the device. In addition, the device is quite simple to use, only turning its motor on for rivet spinning when the operator has manipulated its handle.

SUMMARY OF THE INVENTION

A rivet spinner for saw chain rivets includes a main frame having upper and lower portions, with force transmitting means slidably and rotatably mounted on the upper frame portion. The force transmitting means has a spindle with a lower end formed as a rivet spinning surface. Rivet support means are mounted on the lower portion of the main frame under and axially aligned with the spindle and rivet spinning surface thereon. Cam means are provided for selectively sliding the force transmitting means toward the lower portion of the main frame to bring the rivet spinning surface into engagement with a chain saw rivet positioned on the rivet support means. Spin means are also provided responsive to position of the force transmitting means for rotating the rivet spinning surface of the force transmitting means only when the force transmitting means is moved toward the lower portion of the main frame.

In a preferred embodiment, the means for selectively sliding the force transmitting means toward the lower portion of the mainframe is a manually actuated cam which, when actuated, moves the spindle between a raised position and a lowered position. The manually actuated cam includes a cam member pivotally mounted with respect to the rotatable spindle and upper frame portion on a generally horizontal axis, with the cam member being partially defined by a first surface which engages a cam-engaging surface of the spindle when the cam member is in a first position and the spindle is in its raised position and a second surface which engages the cam engaging surface of the spindle when the cam member is pivoted to a second position and urges the spindle downwardly into its lowered position. A handle is preferably fixedly associated with the cam member so that generally downward movement of the handle pivots the cam member from its first position to its second position.

The spin means for rotating the rivet spinning surface of the force transmitting means is preferably an electric motor. The motor is responsive to the movement of the force transmitting means by means of a switch mounted adjacent the upper frame portion and positioned so that downward movement of the force transmitting means engages the switch to move it to an "on" position whereby the motor is actuated to rotate the spindle. The switch is normally biased to an "off" position so that when the force transmitting means is moved upwardly away from the lower frame portion, it is separated from the switch and the switch returns to its off position which turns off the motor.

BRIEF DESCRIPTION OF THE DRAWINGS

FIG. 3 is an enlarged fragmentary view of the rivet engaging portions of the saw chain rivet spinner of the present invention, with some parts broken away and some parts shown in section.

FIG. 4 is an enlarged frontal fragmentary view of the cam assembly of the saw chain rivet spinner of the present invention, with some parts shown in section.

FIG. 5 is a sectional view as taken along line 5—5 in FIG. 4.

DETAILED DESCRIPTION OF THE PREFERRED EMBODIMENTS

Figure 2:
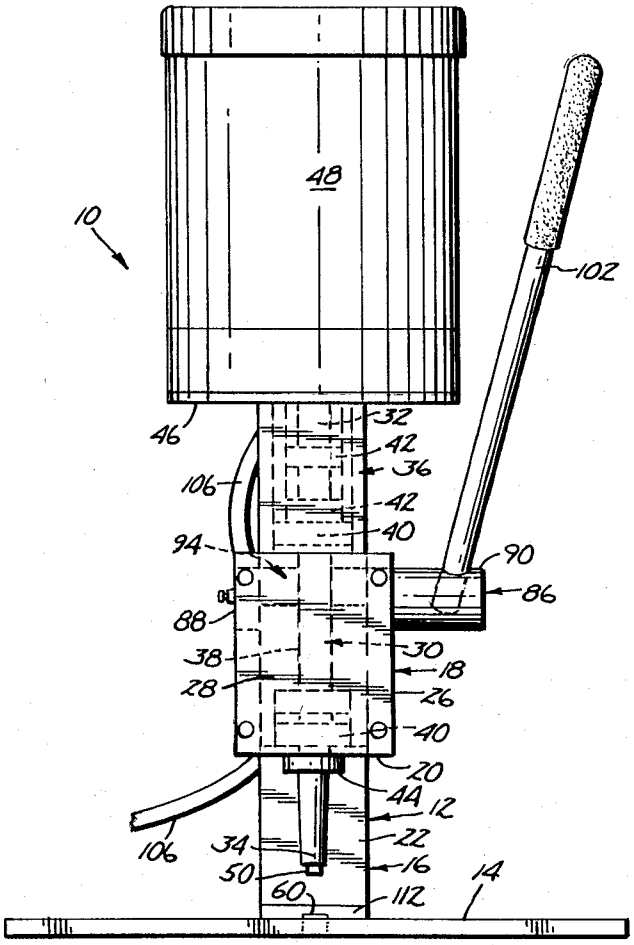
FIG. 2 is a front elevational view of the saw chain rivet spinner of the present invention.
Figure 1:
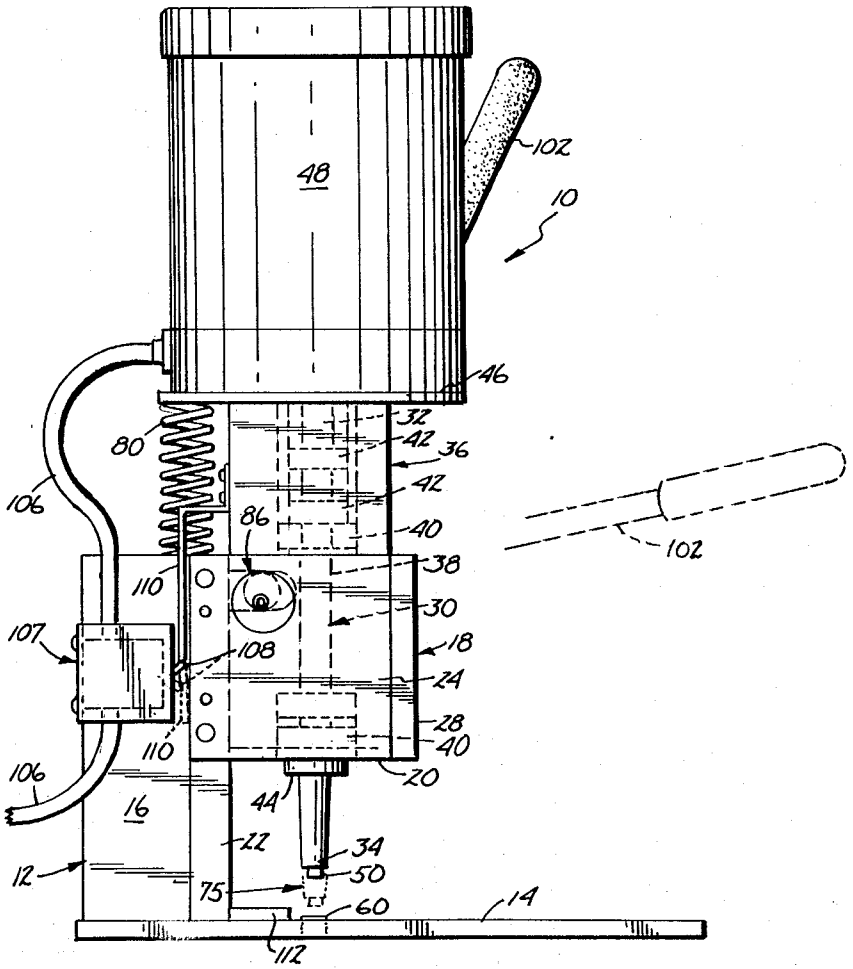
FIG. 1 is a side elevational view of a saw chain rivet spinner of the present invention.

A saw chain rivet spinner 10 of the present invention is best shown in FIGS. 1 and 2. The rivet spinner 10 has a main frame 12 which includes a generally horizontal base or frame portion 14. The main frame 12 also includes a support portion 16 secured to the base 14 and extending upwardly up therefrom as shown. A generally vertical spindle sleeve 18 is secured to the support portion 16 so that a lower end 20 of the spindle sleeve 18 is spaced from and above the base 14. The spindle sleeve 18, support portion 16 and base 14 all comprise the main frame 12 and are fixedly mounted with respect to each other.

The support portion 16 has an upward back plate 22, an upper portion of which makes up a part of the spindle sleeve 18. The spindle sleeve 18 also includes first and second side members 24 and 26 which are fixedly secured to the upward back plate 22 adjacent its upper portion. A forward plate member 28 is fixedly secured to each of the first and second side plate members 24 and 26 so that the upper portion of the back plate 22, the first and second side plate members 24 and 26 and the forward plate member 28 together to define the spindle sleeve 18.

A rotatable spindle 30 is slidably movable with respect to the spindle sleeve 18. The spindle 30 has an upper end portion 32 and a lower end portion 34 which define a generally vertical axis of rotation for the spindle 30. The spindle 30 is slidably mounted with respect to the spindle sleeve 18 for axial movement in the generally vertical direction relative to the spindle sleeve 18. The spindle 30 is mounted in a generally rectangular spindle frame 36, which is slidably receivable with the generally vertical spindle sleeve 18 as shown. The spindle frame 36 has a throughbore 38 extending generally vertically therethrough for acceptance of the spindle 30. Additionally, a plurality of bearings 40 and spacers 42 are positioned in the throughbore of the spindle frame 36 to maintain the rotatable spindle 30 in axial alignment. A thrust collar 44 is additionally positioned about the spindle 30 adjacent the lower end 20 of the spindle sleeve 18.

A reaction plate 46 is secured to the spindle frame 36 adjacent the upper end portion 32 of the spindle 30. In a preferred embodiment, an electric motor is mounted on the reaction plate 46 as shown. The motor 48 is operably coupled to the spindle 30 so that actuation of the motor 48 rotates the spindle 30 about its axis.

As best shown in FIG. 3, a rivet anvil 50 is fixedly secured on the lower end portion 34 of the spindle 30. The rivet anvil 50, which is removably mounted on the spindle 30, has a forming head 52 with a rivet spinning surface 54 thereon (axially aligned with the axis of the spindle 30) for engaging an unformed end of a rivet.

A rivet support die 60 is mounted on the base 14 axially aligned under the spindle 30 and rivet spinning surface 54 of the rivet anvil 50. For use, a rivet 62 of a saw chain 64 is positioned with its formed head 66 engaging a support portion 69 of the rivet support die 60, as shown in FIG. 3. An unformed end 68 (shown in phantom in FIG. 3) of the rivet 62 extends generally upwardly toward the lower end portion 34 of the spindle 30. When the spindle 30 is moved axially downwardly toward the base 14, the rivet spinning surface 54 engages the unformed end 68 of the rivet 64. When the motor 48 is actuated to rotate the spindle 30 and rivet anvil 50 fixedly mounted thereon, the engagement of the rotating rivet spinning surface 54 with the unformed end 68 of the rivet 64, along with an applied pressure downwardly on the spindle 30, causes the unformed end 68 to be spun or "formed " into a rivet head 70, as shown in FIG. 3. Unlike the rivet anvils used on prior art rivet spinning devices, the rivet anvil 50 does not have or need any special features to aid in centering its rivet spinning surface 54 on the unformed end 68 of the rivet 62, since the rivet anvil 50 is already fully aligned axially by the spindle 30 over a rivet 62 positioned on the rivet support die 60.

The spindle 30 (and the rivet anvil 50 carried thereon) is axially movable with respect to the spindle sleeve 18 between a first spindle raised position (shown in solid in FIG. 1) and a second spindle lowered position (shown in phantom as at 75 in FIG. 1). The spindle frame 36, reaction plate 46 and motor 48 carried thereon also move with the spindle 30 when it is moved up and down relative to the spindle sleeve 18. A spring 80 is positioned in compression between a lower surface of the reaction plate 46 and an upper surface of the support portion 16, as shown in FIG. 1. The urging force of the spring 80 urges the reaction plate 46 normally upwardly away from the main frame 12 of the rivet spinner 10. In turn, the spindle frame 36 and spindle 30 carried therein are also urged upwardly away from the base 14 so that the spindle is positioned in its first raised position by action of the spring 80.

The spindle 30 is selectively moved axially by a cam assembly acting between the spindle sleeve 18 and spindle frame 36. In a preferred embodiment, the spindle frame 36 has a throughbore 32 extending generally horizontally therethrough (as shown in FIGS. 4 and 5) which has a cam-engaging surface 84 thereon. The spindle 30 is fixedly associated with the spindle frame 36 so that the spindle 30, spindle frame 36 and cam-engaging surface 84 all move slidably together with respect to the spindle sleeve 18.

The first and second side plate members 24 and 26 have coaxial circular apertures therein for acceptance of a pivoting cam member 86. The cam member 86 includes first and second spaced apart cylindrical portions 88 and 90 which have a generally horizontal axis of rotation defining a pivot axis 92 for the cam member 86. A third cylindrical portion 94 fixedly connects the first and second cylindrical portions 88 and 90 and has an axis spaced from and parallel to the pivot axis 92. The third cylindrical portion 94 has a smaller diameter than the first and second cylindrical portions 88 and 90, as best shown in FIG. 5.

The third cylindrical portion 94 extends through the throughbore 82 of the spindle frame 36 (as shown in FIGS. 4 and 5), while the first and second cylindrical portions 88 and 90 are pivotally mounted (on pivot axis 92) in the first and second side plate members 24 and 26, respectively. The third cylindrical portion 94 has an outer or arcuate surface 96 thereon which engages the cam engaging surface 84 of the spindle frame 36. The radial axis for the arcuate surface 96 is preferably the axis of the third cylindrical portion 94 and is thus spaced from and parallel to the pivot axis 92 of the cam member 86.

The arcuate surface 96 has a first cam surface portion 98 (proximate the pivot axis 92) which engages the cam-engaging surface 84 when the cam member 86 is in a first position (as shown in solid in FIG. 5) and the spindle 30 is in its first raised position. The arcuate surface 96 has a second cam surface portion 100 (radially spaced from the pivot axis 92) which engages the cam-engaging surface 84 when the cam member 86 is pivoted to a second position (as shown in phantom in FIG. 5). As shown, when the cam member 86 is pivoted to its second position so that the second cam surface portion 100 is presented to the cam-engaging surface 84, the spindle 30 is urged downwardly toward its second lowered position. A lower edge 101 of the spindle frame 36 moves with respect to the spindle sleeve 18 (see FIG. 5) to the same extent as the spindle 30.

Movement of the cam member 86 about its pivot axis 92 (which is generally perpendicular to the axis of the spindle 30) rotates the third cylindrical portion 94 in an eccentric manner across the cam-engaging surface 84 to move the spindle 30 between its raised position wherein the first cam surface 98 engages the cam-engaging surface 84 and the lower positioned wherein the second cam surface 100 engages the cam-engaging surface 84. When the spindle 30 is moved to its second lowered position, the rivet anvil 50 is brought into engagement with a rivet 62 positioned on the rivet support die 60 for forming a rivet head 70 from the unformed end 68 of the rivet 62.

The cam member 86 is pivoted manually about the pivot axis 92 by a handle 102 which is fixedly secured to the second cylindrical portion 90 of the cam member 86 as shown. When the cam-engaging surface 84 is engaged by the first cam surface 98, the handle 102 is in a generally upright position as indicated in FIGS. 1, 2 and 5. When the handle 102 is pulled downwardly (as indicated in phantom in FIGS. 1 and 5) the arcuate surface 96 of the third cylindrical portion 94 rotates across the cam-engaging surface 84 to present the second cam surface 100 thereto. In so doing, the third cylindrical portion 94 moves eccentrically about the pivot axis 92 such that the second cam surface 100 is closer to the base 14 than the first cam surface 98. The cam-engaging surface 84 is thus forced toward the base 14, which also forces the spindle sleeve 36 and spindle 30 toward the base 14. To do this, the urging force of the spring 80 must be overcome in order to move the spindle 30 downwardly. Once downward pressure on the handle 102 is released, the urging force of the spring 80 forces the spindle 30 back to its spindle raised position as shown in FIG. 2 (and the handle 102 returns to its upright position as the cam member 86 pivots back to its raised position wherein the first cam surface 98 engages the cam-engaging surface 84). The cam assembly (operated by handle 102) thus provides means for selectively moving the spindle 30 axially toward the base 14.

To reduce the friction between the engaging portions of the third cylindrical portion 94 and the spindle frame 36, the cam member 86 is provided with means to lubricate those engaging elements. As shown in FIG. 4, a zerk fitting 103 is mounted on the first cylindrical portion 88 of the cam member 86. A lubricant conduit 104 leads to an apertures 105 in the arcuate surface 96 of the third cylindrical portion 94. A suitable lubricant, such as grease, can thus be fed through the zerk fitting 103, conduit 104 and aperture 105 into and between the arcuate surface 96 and the cam-engaging surface 84 to reduce the friction therebetween and facilitate movement of the cam member 86 and spindle frame 36.

The electric motor 48 is supplied with power through cord 106 from a power source (not shown) such as a common electrical outlet. An on/off switch 107 interrupts cord 106 and is positioned on the main frame 12 to control selectively the actuation of the motor 48. The switch 107 is responsive to the position of the spindle 30 such that the motor 48 is only actuated when the spindle 30 is moved downwardly out of its first raised position toward its second lowered position. Preferably, the switch 107 is a two-position toggle-type switch or microswitch. In the case of a toggle-type switch, the switch 107 has a pivoting switch actuation toggle 108 which is normally biased away from the base 14 and toward the motor 48 in a toggle-up/switch-off position (wherein the switch 107 is in a switch-open position or state and the motor 48 is off). The toggle 108 has a toggle-down/switch-on position (wherein the switch 107 is in a switch-closed position or state and the motor 48 is on) when pivoted toward the base 14 as shown in phantom in FIG. 1.

A follower bracket 110 is secured to the spindle frame 36 and moves with the spindle frame 36 and spindle 30 when they are moved slidably with respect to the spindle sleeve 18. The follower bracket 110 is positioned such that when the spindle 30 is moved downwardly toward its second lowered position, the follower bracket 110 engages the toggle 108 of the switch 107 to move the toggle 108 from its toggle-up position to its toggle-down position. When the toggle 108 is forced into its toggle-down/switch-on position, the switch 107 is closed to actuate the motor 48. In FIG. 1, the follower bracket 110 is shown in solid when the spindle 30 is in its first raised position and in phantom when the spindle 30 is in its second lowered position. As shown, the toggle 108 of the switch 106 is responsive to position of the spindle 30, being pivoted to its toggle-down position when the follower bracket 110 is moved toward the base 14 with the spindle 30. When a microswitch is used instead of a toggle-type switch, the actuator portion or button (not shown) of the microswitch is normally biased to a switch-off position and the switch is only turned on when the follower bracket 110 engages the actuator portion or button of the microswitch to place it in a switch-on position and actuate the motor 48.

A saw chain alignment plate 112 is positioned on the base 14 to provide an alignment means for maintaining a saw chain 64 in position while a selected rivet 62 thereon is engaged by the rivet anvil 50 and rivet support die 60. The alignment plate 112 is secured to the base 14 adjacent the rivet support die 60 and positioned to abut a portion of the saw chain 64 proximate the selected rivet 62 to limit undesirable movement of that saw chain portion while the selected rivet 62 is engaged by the rivet anvil 50 and rivet support die 60. Preferably, the alignment plate 112 is positioned on the base 14 between the support portion 16 and the rivet support die 60, as shown in FIG. 1.

Saw chains come in different sizes for different makes of chain saws. To accommodate the different sizes of saw chain, which have different sizes of rivets, the rivet anvil 50 of the saw chain rivet spinner 10 of the present invention is removably mounted on the lower end portion 34 of the rotatable spindle 30. The spindle 30 includes an anvil mounting aperture 114 and each rivet anvil 50 has a similarly shaped mounting portion 115 which is selectively securable in the aperture 114, as best shown in FIG. 3. The mounting portion 115 slides or slips into and out of the anvil mounting aperture 114, and rivet anvil 50 is held in position axially by an O-ring 116 mounted about the mounting portion 115 which deforms to grip the spindle 30 when the mounting portion 115 is inserted in the aperture 114, as shown in FIG. 3.

Rivet anvils with different sized forming heads 52 and rivet spinning surfaces 54 can thus be alternatively mounted on the spindle 30. A plurality of rivet anvils 50 are provided for the rivet spinner 10, with each rivet anvil 50 having its forming head 52 sized for a particular type of saw chain rivet and each rivet anvil 50 having a mounting portion 115 for engagement with the anvil mounting aperture 114 on the lower end portion 34 of the spindle 30. Rivet anvils 50 are thus interchangably mounted on the chain saw rivet spinner 10 depending upon the type of saw chain 64 to be worked on. A worn rivet anvil 50 can also be easily replaced.

The rivet support die 60 is also removably mounted on the base 14. The base 14 includes a die mounting aperture 118 and the rivet support die 60 has a mounting portion 120 which is selectively securable in the mounting aperture 118, as best shown in FIG. 3. After use, the support portion 69 of a rivet support die 60 may become worn and ineffective for spinning rivet heads. The worn rivet support die 60 can then be removed from the aperture 118 in the base 14 and replaced.

The rivet spinner 20 can also be used as a rivet punch device to break apart the elements of a saw chain. For such use, a rivet punch (not shown) is mounted on the lower end portion 34 of the spindle 30. Actuation of the cam member 86 thus drives the spindle 30 and the rivet punch down against a rivet positioned thereunder to force it out of the saw chain elements. Once the rivet has been punched out, the spindle 30 is allowed to return to its raised position so that the rivet punch is withdrawn from the saw chain elements and now disconnected saw chain elements can be removed.

For use as a rivet spinner, a desired rivet anvil 50 is mounted on the spindle 30 of the rivet spinner 10 above the rivet support die 60. The portion of the saw chain 64 to be worked is positioned under the spindle 30 with the rivet 62 to be "headed" positioned on the support portion 69 of the rivet support die 60 as shown in FIG. 3. The spindle 30 and spindle frame 36 comprise means to transmit force along the axial length of the spindle 30 against the rivet 62 to be worked. The force transmitted is selectively applied by acutation of the cam member 86. When the handle 102 is pulled downwardly to pivot the cam member 86, its eccentric portion (third cylinder portion 94) acts against the cam-engaging surface 84 of the spindle frame 36 to force it toward the base 14. The spindle 30 is not rotated by the motor 48 unless the cam member 86 is pivoted so that the spindle frame 36 moves toward the base 14. Only when the follower bracket 110 engages and moves the actuator portion or toggle of the switch 107 to its switch-on position does the motor 48 become actuated to rotate the spindle 30. At that point, the spindle 30 begins rotating, along with the rivet anvil 50 mounted thereon and the rivet spinning surface 54 of the rivet anvil 50. The rivet spinning surface 54 is therefore rotating when it engages the unformed end 68 of the rivet 62.

Continued pressure on the handle 102 further forces the spindle frame 36 (and spindle 30) toward the base 14 to exert pressure on the unformed end 68 of the rivet 62 while the spindle 30 is spinning to form a rivet head 70 therein (see FIG. 3). The rivet head 70 is formed by a combination of the compressive force exerted along the length of the rivet 62 by the spindle 30 and the spinning motion of the rivet spinning surface 54. Shoulder portions 121 on the forming head 52 of the rivet anvil 50 engage the saw chain 64 to limit the downward extent of travel of the rivet anvil 50 and define the general shape of the rivet head 70, as shown in FIG. 3. Once the rivet head 70 has been formed as desired, the pressure on the handle 102 of the cam member 86 is released and the spring 80 urges the spindle 30 and rivet anvil 50 away from the base 14. That portion of the saw chain 64 can then be removed from the rivet spinner 10 and a new portion of saw chain to be worked can be positioned for operation.

Although the present invention has been described with reference to preferred embodiments, workers skilled in the art will recognize that changes may be made in form and detail without departing from the spirit and scope of the invention.

What is claimed is:

1. A rivet spinner for saw chain rivets which comprises:

a generally horizontal base portion;

a generally vertical spindle sleeve supported from and above the base portion;

a rotatable spindle having a generally vertical axis of rotation and being slidably movable axially with respect to the spindle sleeve between a first raised position and a second lowered position;

spring means for urging the rotatable spindle toward its first raised position;

manually actuated cam means for selectively moving the rotatable spindle from its first raised position to its second lowered position;

a rivet support die mounted on the base portion, the support die being axially aligned under the rotatable spindle and formed to support a saw chain rivet;

a rivet anvil fixedly secured on a lower end of the rotatable spindle for engaging the rivet supported by the support die when the spindle is moved to its second lowered position;

motor means for rotating the spindle and rivet anvil; and switch means for actuating the motor means, the switch means being responsive to the position of the rotatable spindle such that the motor means is only actuated when the spindle is moved downwardly out of its first raised position toward its second lowered position.

2. The rivet spinner of claim 1 wherein the switch means comprises:

a two-position switch having a first position defining a switch-open/motor-off state and a second position defining a switch-closed/motor-on state, the switch being normally biased to its first position; and a follower bracket connected to follow movement of the rotatable spindle and positioned such that when the spindle is moved downwardly toward its second lowered position, the follower bracket engages the switch to move it from its first position to its second position.

3. The rivet spinner of claim 1, and further comprising:

saw chain alignment means on the base portion for positioning a portion of a saw chain while a selected rivet thereon is supported on the rivet support die.

4. A rivet spinner for saw chain rivets which comprises:

a main frame having first and second spaced apart frame portions;

force transmitting means movably and rotatably mounted with respect to the first frame portion, the force transmitting means including a spindle having an end proximate the second frame portion formed as a rivet spinning surface;

rivet support means mounted on the second frame portion of the main frame axially aligned with the spindle and rivet spinning surface thereon;

cam means for selectively moving the force transmitting means toward the second frame portion of the main frame to bring the rivet spinning surface into engagement with a chain saw rivet positioned on the rivet support means; and spin means responsive to position of the force transmitting means for rotating the rivet spinning surface of the force transmitting means only when the force transmitting means is moved toward the second frame portion of the main frame.

5. The rivet spinner of claim 4 wherein the spin means comprises:

a drive motor operably connected to the spindle for rotation thereof; and a switch for the drive motor mounted between the main frame and the force transmitting means, with the switch being triggered to actuate the drive motor by movement of the force transmitting means toward the second frame portion.

6. The rivet spinner of claim 5 wherein the switch has a pivoting switch actuation toggle, the toggle being normally biased toward the first frame portion in a switch-off position, the toggle having a switch-on position when pivoted toward the second frame portion, the toggle being engaged by the force transmitting means as the force transmitting means moves toward the second frame portion which pivots the toggle to its switch-on position to trigger the switch and actuate the drive motor causing the spindle to be rotated.

7. The rivet spinner of claim 4 wherein the force transmitting means has a cam-engaging surface and is movable between a first position where the rivet spinning surface is proximate the first frame portion and a second position where the rivet spinning surface is proximate the second frame portion, and wherein the cam means comprises:

a cam member pivotally mounted between the first frame portion and the force transmitting means on a cam pivot axis generally perpendicular to an axis of the spindle, the cam member having an eccentric portion which has a first surface proximate the cam pivot axis to engage the cam-engaging surface of the force transmitting means when the force transmitting means is in its first position and a second surface radially spaced from the cam pivot axis to engage the cam-engaging surface of the force transmitting means when the force transmitting means is in its second position; and handle means fixedly associated with the cam member for pivoting the cam member about the cam pivot axis to selectively present the first and second surfaces of the eccentric portion of the cam member to the cam-engaging surface to cause movement of the force transmitting with respect to the first frame portion.

8. A rivet spinner for saw chain rivets which comprises:

a base;

a support portion secured to and extending upwardly from the base;

a spindle sleeve secured to the support portion and spaced above the base;

a rotatable spindle having an upper end and a lower end and defining a generally vertical axis of rotation, the spindle being slidably mounted with respect to the spindle sleeve for axial movement relative to the spindle sleeve;

spring means mounted with respect to the rotatable spindle and spindle sleeve for urging the spindle axially upwardly;

manually actuated cam means mounted with respect to the rotatable spindle and spindle sleeve for selectively moving the spindle axially downwardly toward the base;

a rivet anvil mounted on the lower end of the rotatable spindle for engaging a saw chain rivet when the spindle is moved downwardly;

a rivet support die mounted on the base aligned to support the rivet engaged by the rivet anvil;

motor means adjacent the upper end of the rotatable spindle for rotating the spindle and rivet anvil thereon; and switch means responsive to position of the rotatable spindle for actuating the motor means only when the rotatable spindle is moved downwardly by actuation of the cam means.

9. The rivet spinner of claim 8 wherein the rotatable spindle is slidably movable along its axis between a raised position and a lowered position and has a cam-engaging surface connected thereto for slidable movement therewith, and wherein the manually actuated cam means comprises:

a cam member pivotally mounted with respect to the rotatable spindle and spindle sleeve on a generally horizontal pivot axis, the cam member being partially defined by a first cam surface which engages the cam-engaging surface when the cam member is in a first position and the spindle is in its raised position and a second cam surface which engages the cam-engaging surface when the cam member is pivoted to a second position and urges the spindle downwardly into its lowered position; and handle means fixedly associated with the cam member so that movement of the handle means pivots the cam member between its first and second positions.

10. The rivet spinner of claim 9 wherein the cam member has an arcuate surface thereon, the arcuate surface having a radial axis spaced from and parallel to the pivot axis, with the first and second cam surfaces of the cam member being constituted as portions of the arcuate surface such that movement of the cam member about the pivot axis rotates the arcuate surface across the cam-engaging surface between a first position whrein the first cam surface engages the cam-engaging surface of the spindle and a second position wherein the second cam surface engages the cam-engaging surface of the spindle.

11. The rivet spinner of claim 9 wherein the cam member comprises first and second spaced apart cylindrical portions having a common axis of rotation which defines the pivot axis of the cam member and a third cylindrical portion fixedly connecting the first and second cylindrical portions, the third cylindrical portion having an axis spaced from and parallel to the pivot axis, having a smaller diameter than the first and second cylindrical portions and having portions of an outer surface thereof being constituted as the first and second cam surfaces of the cam member such that movement of the cam member about the pivot axis rotates the outer surface of the third cylindrical portion across the cam-engaging surface in an eccentric manner between a spindle raised position wherein the first cam surface engages the cam-engaging surface and a spindle lowered position wherein the second cam surface engages the cam-engaging surface.

12. The rivet spinner of claim 8 wherein the switch means comprise:

a switch mounted on the support portion, the switch having a actuator portion normally biased to a switch-open position whereby the motor means is not actuated and having a switch-closed position whereby the motor means is actuated; and a bracket member connected to the rotatable spindle to move axially therewith, the bracket member aligned to engage the actuator portion of the switch when the spindle is moved downwardly and move the actuator portion to its switch-closed position.

13. The rivet spinner of claim 8 wherein the rivet anvil is removably mounted on the lower end of the rotatable spindle.

14. The rivet spinner of claim 8 wherein the rotatable spindle includes releasable anvil mounting means for mounting one of a plurality of rivet anvils at the lower end of the spindle, each rivet anvil having a mounting portion for engagement with the mounting means and having a rivet head forming portion sized for a particular type of chain saw chain rivet.

15. The rivet spinner of claim 8 wherein the base includes die mounting means for removably mounting the rivet die with respect to the base.

16. The rivet spinner of claim 8, and further comprising alignment means for maintaining a saw chain in position while a selected rivet thereon is engaged by the rivet anvil and rivet support die.

17. The rivet spinner of claim 16, wherein the alignment means is a plate member secured to the base adjacent the rivet support die and positioned to abut a portion of the saw chain proximate the selected rivet to limit undesirable movement of that saw chain portion while the selected rivet is engaged by the rivet anvil and rivet support die.

18. The rivet spinner of claim 17 wherein the plate member is positioned on the base between the support portion and rivet support die.

* * * * *